United States Patent [19]

Tominaga et al.

[11] 4,115,331

[45] * Sep. 19, 1978

[54] SURFACE SIZING COMPOSITIONS FOR PAPER

[75] Inventors: Yoichi Tominaga; Yasuo Shibahara, both of Kyoto, Japan

[73] Assignee: Sanyo Chemical Industries, Ltd., Kyoto, Japan

[ * ] Notice: The portion of the term of this patent subsequent to Dec. 9, 1992, has been disclaimed.

[21] Appl. No.: 758,480

[22] Filed: Jan. 11, 1977

Related U.S. Application Data

[62] Division of Ser. No. 474,544, May 30, 1974, Pat. No. 4,030,970.

[30] Foreign Application Priority Data

May 31, 1973 [JP] Japan ..... 48-61503

[51] Int. Cl.[2] ..... C08L 1/28; C08L 3/10; C08L 5/04; C08L 29/04

[52] U.S. Cl. ..... 260/17.4 CL; 260/17.4 ST; 260/27 R; 260/29.6 TA; 260/901; 526/240

[58] Field of Search ..... 260/17.4 CL, 17.4 ST, 260/27 R, 901

[56] References Cited

U.S. PATENT DOCUMENTS

| | | | |
|---|---|---|---|
| 2,999,038 | 9/1961 | Drennen et al. | 427/391 |
| 3,726,822 | 4/1973 | von Bonin et al. | 162/168 |
| 3,865,765 | 2/1975 | Drelich et al. | 260/17.4 ST |
| 3,876,452 | 4/1975 | Anspon et al. | 526/240 |
| 3,925,328 | 12/1975 | Shibahara et al. | 162/168 |
| 4,030,970 | 6/1977 | Tominaga et al. | 162/168 R |

FOREIGN PATENT DOCUMENTS

| | | | |
|---|---|---|---|
| 728,763 | 2/1969 | Belgium. | |
| 2,357,165 | 5/1974 | Fed. Rep. of Germany | 162/168 |
| 437,446 | 10/1935 | United Kingdom | 260/29.6 AT |

*Primary Examiner*—Stanford M. Levin
*Attorney, Agent, or Firm*—Oblon, Fisher, Spivak, McClelland & Maier

[57] ABSTRACT

A paper surface-sized with a surface sizing composition, which comprises a copolymer of acrylic or methacrylic ester, alkai metal salts of acrylic or methacrylic acid, and acrylic or methacrylic acid, or lower alkyl amine salts thereof.

10 Claims, No Drawings

SURFACE SIZING COMPOSITIONS FOR PAPER

This is a division of application Ser. No. 474,544, filed May 30, 1974, now U.S. Pat. No. 4,030,970.

BACKGROUND OF THE INVENTION

1. Field of the Invention

This invention relates to surface sizing compositions for paper making. More particularly, this invention relates to stable surface sizing compositions which can be used in surface sizing of paper sheeted under wide pH ranges, especially neutral conditions (pH 6–9).

2. Description of the Prior Art

Current procedures for paper sizing involve two principal methods: (1) "internal sizing" wherein the sizing agent is mixed with pulp and thereafter the mixture is formed into a sheet having a uniform distribution of fibers and sizing agent, and (2) "surface sizing" wherein a sizing agent is applied to the surface of an already formed paper. Surface sizing has some advantages over internal sizing. For example, it leads to substantial savings in sizing cost and to improvment in paper quality, e.g., good writability, because almost all of the sizing composition is retained on the surface of the treated paper. Surface sizing may soon replace internal sizing in popularity.

However, surface sizing has some difficulties. The sizing is made in a size press. The size press is continuously operated at a high speed to increase the productivity, and under a high pressure in order to apply a sizing solution to the surface of the paper as uniformly as possible. In such a sizing operation, the sizing solution suffers heat and mechanical shock which are generated during the operation. In addition, aluminum salts such as alum elute from the paper into the sizing solution. These salts have been used in the wet end of the sheeting step. These eluted salts have some adverse effect on the sizing solution, because they facilitate precipitation of materials from the sizing solution. Therefore, the sizing agent which is the main ingredient of the sizing solution should be stable to heat, mechanical shock and be able to resist the aluminum salts.

Heretofore, various kinds of natural and synthetic resins have been proposed and used as surface sizing compositions. Some typical examples of the resins are a modified rosin, modified petroleum resin, styrene-maleic anhydride copolymer and alkyl ketene dimer.

However, these resins are not satisfactory, although some of them have a few advantages. A sizing solution containing a conventional sizing composition gradually loses its solubilizing property toward the components because of the heat, mechanical shock and aluminum ions. This gradually results in the formation of scum. The presence of scum causes a decrease in the sizing effect of the sizing solution, and has an adverse effect on the appearance of the treated paper because of the deposition of the scum on the surface of paper. Therefore, the sizing with a conventional sizing composition requires such troublesome operations as strict pH control of the sizing solution, frequent renewal of the sizing solution and washing of the size press and pipes, and eventually conventional sizing compositions cannot be used in a continuous sizing operation.

Another disadvantage of the conventional sizing compositions is that sizing effects vary widely depending upon the pH conditions under which the paper to be surface-sized has been made at the sheeting step. For example, a modified rosin and modified petroleum resin have good sizing effects only on paper that has been made by sheeting under acidic conditions of pH 4.0 – 5.0. Alkyl ketene dimer has a good sizing effect only on paper that has been made under neutral conditions (slightly acidic to slightly alkaline). Styrene-maleic anhydride copolymer is applicable to paper sheeted under wide pH ranges, but has no satisfactory sizing effect on paper made under neutral conditions. A need, therefore, continues to exist for a surface sizing composition which has a good sizing effect on paper sheeted under wide pH ranges, and which is stable to mechanical shock, heat and alum.

SUMMARY OF THE INVENTION

Accordingly, one object of this invention is to provide a surface sizing composition having improved properties.

Another object of this invention is to provide a surface sizing composition having good stability under operating conditions.

Yet another object of this invention is to provide a surface sizing composition which imparts improved properties to paper which has been made by sheeting under wide pH ranges.

Briefly, these objects and other objects of the invention as hereinafter will become more readily apparent can be attained broadly by a surface sizing composition which comprises a copolymer having at least one structural unit (A) of the formula (1):

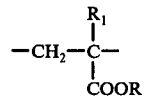

(1)

wherein $R_1$ is H or methyl, and R is a hydrocarbon radical having 1 – 18 carbon atoms, at least one structural unit (B) of the formula (2):

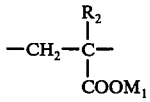

(2)

wherein $R_2$ is H or methyl and $M_1$ is an alkali metal, and at least one structural unit (C) of the formula (3):

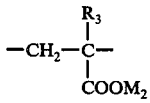

(3)

wherein $R_3$ is H or methyl and $M_2$ is ammonium, lower alkyl amine cation or H.

DESCRIPTION OF THE PREFERRED EMBODIMENTS

As mentioned above, $R_1$, $R_2$ and $R_3$ in the above formulas (1), (2) and (3) are independently hydrogen atoms or methyl groups. The R in formula (1) is a hydrocarbon radical having 1 – 18 carbon atoms. Suitable hydrocarbon radicals include methyl, ethyl, n-propyl, isopropyl, n-butyl, isobutyl, hexyl, octyl, 2-ethylhexyl, decyl, dodecyl, tridecyl tetradecyl, hexadecyl, octadecyl, cyclohexyl, benzyl, and octylbenzyl radicals. The preferred are alkyl groups having 4 – 8 carbon atoms. The $M_1$ in formula (2) is an alkali metal. Suitable alkali metals include sodium and potassium. The $M_2$ (non-metal group) in formula (3) is H, ammonium or lower alkyl ($C_{1-3}$) amine cation (as used herein, the term "lower alkyl" is intended to include hydroxyloweralkyl).

Suitable lower alkyl amines which form the cationic group include monomethyl amine, dimethyl amine, trimethyl amine, monoethyl amine, diethyl amine, triethyl amine, monopropyl amine, monoethanol amine, diethanol amine and triethanol amine. The preferred amines are lower alkyl amines having a molecular weight not more than 120 and boiling point not more than 100° C. (760 mm Hg).

The $M_2$ in the unit (C) may be a mixture of the above non-metal groups such as a combination of ammonium and hydrogen, lower alkyl amine cation and hydrogen, lower alkyl amine cation and ammonium, and a combination of ammonium, lower alkyl amine cation and hydrogen. When the stability of the copolymer is especially important, $M_2$ in the unit (C) preferably is ammonium, lower alkyl amine or mixtures thereof. On the other hand, the preferred $M_2$ is hydrogen whereby a copolymer having a good sizing effect is obtained.

In this invention the value of the carboxylic equivalent of the copolymer must be 90–500 (preferably 100–200) in the free acid form, wherein the carboxylic equivalent means the molecular weight of the coplymer (reduced to the free acid when the carboxylic group forms a salt) per one carboxylic group. The copolymer having a value less than 90 has no satisfactory sizing effect on the paper, especially on paper which is made by sheeting under neutral conditions, while a value of more than 500 results in a decreased sizing effect and decreased solubility of the copolymer in water. In a sizing operation conducted under severe conditions such as a long continuous operation, it is preferred to use the copolymer which has relatively low value of the carboxylic equivalent, with the range 90–500, because a lower value of the carboxylic equivalent will bring about better solubility of the copolymer in water.

The copolymer in this invention must have a specific molar ratio of the structural units (B) to (C) to attain the objects of this invention such as good sizing effect and good stability. Thus, the range of molar ratios of the units (B) to (C) must be 5–50 to 95–50. Less than 5% of the unit (B) represented by the general formula (2) is not effective enough to improve the stability of the copolymer in the sizing operation, while more than 50% of the unit (B) represented by formula (2) decreases the sizing effect of the copolymer, especially on papers which are made by sheeting under neutral pH conditions. Preferred ratios are 10–25 : 90–75 of the unit (B) to the unit (C) considering both sizing effect and stability of the copolymer.

However, if the stability characteristics of the copolymer are important, it is preferable to use a copolymer having a relatively high ratio of the unit (B) (an alkali metal salt) within the above mentioned range of 5–50%.

Molar ratios of the units (A) to the units (B) plus (C) are generally 1–83 : 99–17.

The copolymer used in this invention may be produced by various known methods. The copolymer is generally produced by copolymerizing a polymerizable monomer of the unit (A) and acrylic acid (and/or methacrylic acid) in the presence of a solvent, chain transfer agent and polymerization initiator, or in the presence of water, chain transfer agent, polymerization initiator and emulsifying agent or dispersing agent, and then neutralizing the resulting copolymer to form salts. The polymerizable monomers, which give the unit (A) are hydrocarbon esters of methacrylic and acrylic acid. Examples of the hydrocarbon radical are the same as the examples of R mentioned above.

Another method of obtaining the copolymer of this invention comprises preparing intermediate copolymers and then subjecting them to hydrolysis. Thus, the intermediate is, for example, produced by copolymerizing acrylamide (or methacrylamide, acrylonitrile, or methacrylonitrile), which is the precurssor of the units (B) and (C), with a monomer of the unit (A), and then the resulting intermediate is hydrolyzed and neutralized to change the amide group (or nitrile group) into a carboxylic group or its salts. The copolymer of this invention may be also produced by copolymerizing monomers of the units (A), (B) and (C).

The copolymer of this invention may contain one or more additional structural units. Examples of ethylenically unsaturated monomers suitable as such a structural unit include vinyl monomers such as styrene, vinyl acetate and vinyl chloride; maleic acid; maleic acid esters such as methyl maleate, ethyl maleate and butyl maleate; and hydroxyethyl acrylate.

The surface sizing composition of this invention may consist of the above-mentioned copolymer alone. However, the copolymer is generally used with modifiers such as modified starches, polyvinyl alcohols, sodium alginates, and carboxymethyl celluloses. The weight ratio of the copolymer to the modifier may be 0.1–50 : 99.9–50. The copolymer may be also used with conventional sizing agents (other modifiers) such as rosins and petroleum resins. Examples of the modified starches are oxidized starches and enzyme converted starches.

The surface sizing composition of this invention may be applied to paper sheets by any conventional method. Thus, the sizing composition may be dissolved or dispersed in water to form a sizing solution (1 – 20% by weight), and then the solution is applied to paper sheets with a size press, and the treated sheets are dried. The sizing solution may be applied by a calender or a doctor knife blade. The surface sizing may be conducted along with light weight coating, under-coating, or the like.

The amount of the copolymer deposited onto the paper is 0.01 – 0.5 g/m$^2$ (solid), preferably 0.05 – 0.3 g/m$^2$ (solid). With respect to the modifier, such as oxidized starches and polyvinyl alcohols, used with the copolymer, the amount of sizing composition deposited onto the paper is 0.5 – 10 g/m$^2$ (solid), preferably 2 – 5 g/m$^2$ (solid).

The paper onto which the sizing composition is applied may vary widely and is independent of the kind of pulp. The paper may contain additives such as fillers, dyestuffs, paper strengthening agents, drainage rate improvers, and internal sizing agents. The internally sized paper is preferably. The paper may be a paper base produced by sheeting under the wide pH ranges of 4 to 9.

The surface sizing composition of this invention has a good sizing effect and good stability in the sizing solution. The sizing solution containing the sizing composition of this invention, therefore, does not form a scum under ordinary operation and even under long and severe operating conditions in size presses. Furthermore, the surface sizing composition of this invention exhibits excellent sizing effects on the paper which is made by sheeting under wide ranges of acidic and neutral conditions (pH 4 – 9).

Having generally described the invention, a more complete understanding can be obtained by reference to certain specific examples, which are included for purposes of illustration only and are not intended to be limiting unless otherwise specified.

EXAMPLE 1

A four-necked, round-bottomed 1000 cc flask equipped with an agitator, a reflux condenser, a dropping funnel, a thermometer and a tube for introduction of nitrogen gas was charged with 120 g of isopropyl alcohol and 56 g of water. The mixture was heated at reflux temperature with stirring under a nitrogen atmosphere. To the mixture was added a solution which was obtained by dissolving 0.5 g of 2,2'-azobisisobutyronitrile in 40 g of butylmethacrylate and 60 g of methacrylic acid slowly over about 2 hours, and then the reaction mixture was kept at reflux temperature for an additional 2 hours. The resulting mixture was cooled to 60° C with a water bath, and neutralized with 2.9 g of NaOH in 10% by weight aqueous sodium hydroxide solution. The resulting neutralized solution was distilled to remove isopropyl alcohol as the water azeotrope, and neutralized with 33.9 g of 28% by weight of aqueous ammonia after being cooled to 60° C.

EXAMPLE 2

Polymerization was conducted by the same method as in Example 1, using 120 g of isopropyl alcohol, 56 g of water, 60 g of methyl methacrylate, 10 g of styrene, 30 g of methacrylic acid and 0.5 g of 2,2'-azobisisobutyronitrile. The resulting polymer solution was neutralized.

EXAMPLE 3

Butyl methacrylate (60 g) and acrylic acid (40 g) were copolymerized in the presence of 0.5 g of ammonium persulfate, 200 g of deionized water, 3.3 g of Carrybon TY-201 (Sulfate of polyoxylakylene higher alcohol ether) and 0.5 g of lauryl mercaptan. The resulting solution was neutralized with potassium hydroxide and ammonium hydroxide.

EXAMPLE 4

Example 3 was repeated except that 30 g of butyl methacrylate, 10 g of dodecyl methacrylate and 60 g of acrylic acid were used.

EXAMPLE 5

Polymerization was carried out by the same method as in Example 1, using 60 g of butyl acrylate, 40 g of acrylamide, 20 g of isopropyl alcohol and 0.5 of 2,2'-azobisisobutyronitrile. The resulting polymer solution was hydrolyzed and neutralized with 9 g of NaOH in 10% by weight of an aqueous solution of sodium hydroxide and 20.5 g of a 28% by weight aqueous solution of ammonia at reflux temperature for about 10 hours.

EXAMPLE 6

Polymerization was conducted by the same method as in Example 1, using 60 g of n-hexyl acrylate, 5.2 g of the sodium salt of acrylic acid, 29.7 g of the ammonium salt of acrylic acid, 21.7 g of the trimethylamine salt of acrylic acid, 30 g of isopropyl alcohol and 10 g of water.

The products obtained in the above Examples 1 - 7 had the physical and chemical properties shown in Table 1.

TABLE 1

| | Concentration (% by weight) | Carboxylic equivalent | Kinds of salt (%) | | Viscosity (cps) | pH |
|---|---|---|---|---|---|---|
| Ex. 1 | 30 | 143 | Na | 10 | 5,000 | 7.3 |
| | | | $NH_4$ | 80 | | |
| | | | free | 10 | | |
| Ex. 2 | 0 | 286 | K | 45 | 6,000 | 9.2 |
| | | | $NH_4$ | 55 | | |
| Ex. 3 | 30 | 180 | K | 15 | 3,000 | 7.5 |
| | | | $NH_4$ | 75 | | |
| | | | free | 10 | | |
| Ex. 4 | 30 | 120 | K | 20 | 4,000 | 7.0 |
| | | | $NH_4$ | 60 | | |
| | | | free | 20 | | |
| Ex. 5 | 30 | 199 | Na | 40 | 1,500 | 9.5 |
| | | | $NH_4$ | 60 | | |
| Ex. 6 | 30 | 228 | Na | 10 | 3,700 | 9.7 |
| | | | $NH_4$ | 60 | | |
| | | | trimethyl amine cation | 30 | | |

Notes:
1) Viscosity was determined in 30% by weight aqueous solution at 30° C
2) The pH was determined in 4% by weight aqueous solution at room temperature.

EXAMPLE 7

(Test of the Stability)

The stability test was conducted with each of the sizing solutions prepared from the copolymer solutions produced in Examples 1-6.

An aqueous sizing solution (5000 cc) was prepared which contained 0.8% by weight of each of the copolymers and 1.2% by weight of an oxidized starch. For comparison, an aqueous sizing solution was prepared by using conventional sizing agents instead of the copolymer of this invention. Each of the sizing solutions was supplied to an inclined lab-size press by a hand pump. Outflow of the solution was recycled. The stability was determined by observing the formation of scum every 30 minutes. Operational conditions were as follows:

| | |
|---|---|
| (1) Press speed: | 100 m/min |
| (2) Nip pressure: | 20 kg/cm |
| (3) Operation time: | 8 hours |
| (4) Temperature of the solution: | Adjusted to 60° C |
| (5) pH of the solution: | Aqueous alum solution (0.5% by weight) |

was added every 60 minutes, so that pH was adjusted to 5.0, four hours after starting.

The results of the stability tests are shown in Table 2.

TABLE 2

| No. | Surface sizing agents | Stability of the sizing solutions |
|---|---|---|
| 1. | Example 1 | No scum in the press operation for more than 8 hours |
| 2. | Example 2 | " |
| 3. | Example 3 | " |
| 4. | Example 4 | " |
| 5. | Example 5 | " |
| 6. | Example 6 | " |
| 7. | Rosin size (conventional) | Much scum in the press operation after only 0.5 hours |
| 8. | Petroleum resin (conventional) | Much scum in the press operation after 1.5 hours |
| 9. | Styrene-maleic anhydride copolymer (conventional) | Much scum in the press operation after 3.0 - 3.5 hours |

EXAMPLE 8

(Test of Sizing Effect)

Test of the sizing effect was conducted with each of the copolymers produced in Examples 1-6 in comparison with some conventional sizing agents. The operational conditions for the sizing tests were as follows:

(1) Base paper produced under high pH range

Paper (water leaf) was produced by sheeting pulp L-BKP at a pH of 8.5. The pulp had a degree of beating of 420 and contained heavy calcium carbonate. The resulting paper (A) had a weight of 65 g/m$^2$ with an ash content of 12% by weight.

(2) Base paper produced under low pH range

Paper was produced by sheeting pulp L-BKP at a pH of 4.5 (adjusted with aluminum sulfate). The pulp had a degree of beating of 420, and contained clay and fortified rosin. The resulting paper had a weight of 65 g/m$^2$ with an ash content of 11% and a rosin content of 0.1 or 1.0% by weight. The paper with a rosin content of 0.1 is hereinafter referred to as "Paper (B)", and the other as "Paper (C)".

(3) Composition of surface sizing solution.

| | (% by weight) |
|---|---|
| Oxidized starch | 6 |
| Each sizing agent (active) | 0.3 |
| Water | 93.7 |
| Total | 100 |

(4) Sizing Operation

The sizing operation was carried out with an inclined labsize press at a speed of 100 m/min. and a nip pressure of 10 kg/cm.

The sized paper was dried at 100° C for 3 minutes. The resulting paper contained 2.0 g/m$^2$ of the oxidized starch and 0.1 g/m$^2$ (0.05 g/m$^2$ for the paper prepared under low pH range) of surface sizing agent.

(5) Results of the tests

The results of the sizing effect tests on Papers (A), (B) and (C) are shown in Tables 3, 4 and 5 respectively.

TABLE 3

| No. | Surface sizing agent | Sizing degree (sec) | Writ-ability | IGT surface strength (cm/sec) |
|---|---|---|---|---|
| 1. | Example 1 | 35.6 | 6 | 260 |
| 2. | Example 2 | 26.3 | 5 | 274 |
| 3. | Example 3 | 28.5 | 5–6 | 263 |
| 4. | Example 4 | 30.4 | 6 | 266 |
| 5. | Example 5 | 25.5 | 5 | 268 |
| 6. | Example 6 | 29.4 | 5–6 | 264 |
| 7. | Rosin size (conventional) | 0 | 0 | 190 |
| 8. | Petroleum size (conventional) | 0 | 0 | 193 |
| 9. | Styrene-maleic anhydride copolymer (conventional) | 15.4 | 3 | 230 |

Notes:
1. Sizing degree was determined by the Stockigt method (JIS P-8122).
2. Writability was tested by the method of J. Tappi Standard No. 12.
3. IGT surface strength was determined by the method of J. Tappi Standard T 499 Su-64, Surface strength of Paper (IGT Tester). (These test methods are the same in Tables 4 and 5).

TABLE 4

| No. | Surface sizing agent | Sizing degree (sec) | Writ-ability | IGT surface strength (cm/sec) |
|---|---|---|---|---|
| 1. | Example 1 | 31.2 | 6 | 205 |
| 2. | Example 2 | 27.5 | 5 | 212 |
| 3. | Example 3 | 28.1 | 5 | 208 |
| 4. | Example 4 | 30.2 | 6 | 210 |
| 5. | Example 5 | 26.8 | 5 | 204 |
| 6. | Example 6 | 28.6 | 5 | 201 |

TABLE 4-continued

| No. | Surface sizing agent | Sizing degree (sec) | Writ-ability | IGT surface strength (cm/sec) |
|---|---|---|---|---|
| 7. | Rosin size (conventional) | 18.5 | 3 | 140 |
| 8. | Petroleum resin (conventional) | 17.7 | 3 | 138 |
| 9. | Styrene-maleic anhydride copolymer (conventional) | 20.8 | 4 | 191 |

TABLE 5

| No. | Surface sizing agent | Sizing degree (sec) | Writ-ability | IGT surface strength (cm/sec) |
|---|---|---|---|---|
| 1. | Example 1 | 48.5 | 6 | 221 |
| 2. | Example 2 | 44.8 | 6 | 240 |
| 3. | Example 3 | 45.1 | 6 | 226 |
| 4. | Example 4 | 47.2 | 6 | 224 |
| 5. | Example 5 | 43.9 | 6 | 226 |
| 6. | Example 6 | 44.2 | 6 | 221 |
| 7. | Rosin size (conventional) | 30.5 | 5 | 153 |
| 8. | Petroleum resin (conventional) | 32.7 | 5 | 150 |
| 9. | styrene-maleic anhydride copolymer (conventional) | 38.8 | 5–6 | 198 |

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. A surface sizing composition for paper which forms substantially no scum in a surface sizing press operation even after 8 hours, which comprises in admixture (I) a copolymer consisting essentially of copolymerized acrylic or methacrylic ester units (A) of the forumla (1):

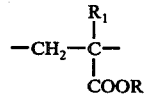

(1)

wherein $R_1$ is H or methyl, and R is a hydrocarbon radical having 1–18 carbon atoms, copolymerized acrylic or methacrylic acid alkali metal salts units (B) of the forumla (2):

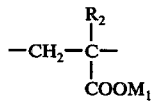

(2)

wherein $R_2$ is H or methyl and $M_1$ is an alkali metal and copolymerized acrylic or methacrylic acid salt units or acid units (C) of the formula (3):

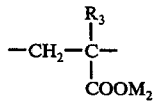

(3)

wherein $R_3$ is H or methyl, and $M_2$ is ammonium, or a combination of ammonium with a lower alkyl amine cation and/or H, wherein said copolymer has a carboxylic equivalent of 90–500 in the free carboxylic form, a molar ratio of units (A) to units (B) and (C) 1–83:99–17, and a molar ratio of units (B) to (C) of 5–50:95–50, with (II) a sizing modifier for said copolymer which is selected from the group consisting of modified starch, polyvinyl alcohol, sodium alginate, carboxy methyl cellulose, rosin and petroleum resin, wherein the weight ratio of said copolymer to said sizing modifier is 0.1–50:99.9–50.

2. A surface sizing composition for paper which forms substantially no scum in a surface sizing press operation even after 8 hours, which comprises in admixture (I) a copolymer having copolymerized acrylic or methacrylic ester units (A) of the formula:

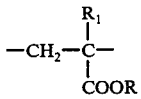

(1)

wherein $R_1$ is H or methyl, and R is a hydrocarbon radical having 1–18 carbon atoms, copolymerized acrylic or methacrylic acid alkali metal salt units (B) of the formula (2);

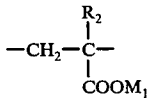

(2)

wherein $R_2$ is H or methyl and $M_1$ is an alkali metal and copolymerized acrylic or methacrylic acid salt units or acid units (C) of the formula (3):

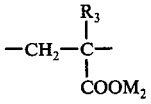

(3)

wherein $R_3$ is H or methyl, and $M_2$ is ammonium, or a combination of ammonium with a lower alkyl amine cation and/or H, wherein said copolymer has a carboxylic equivalent of 90–500 in the free carboxylic form, a molar ratio of units (A) to units (B) plus (C) of 1–83:99–17, and a molar ratio of units (B) to (C) of 5–50:95–50, wherein said copolymer may contain as any additional copolymerized units only styrene, vinyl acetate, vinyl chloride, maleic acid, methyl maleate, ethyl maleate, butyl maleate or hydroxyethyl acrylate units, with (II) a sizing modifier for said copolymer which is selected from the group consisting of modified starch, polyvinyl alcohol, sodium alginate, carboxy methyl cellulose, rosin, and petroleum resin, wherein the weight ratio of said copolymer to said sizing modifier is 0.1–50:99.9–50.

3. The composition of claim 2, wherein $M_2$ is ammonium.

4. The composition of claim 2, wherein $M_2$ is a combination of ammonium with a lower alkyl amine cation and/or H.

5. The composition of claim 2, wherein $M_2$ is a combination of a major proportion of ammonium with a minor proportion of a lower alkyl amine cation and/or H.

6. The composition of claim 2, wherein the modifier is oxidized starch, as the modified starch.

7. The composition of claim 2, wherein the copolymer contains only the acrylic or methacrylic units (A), (B) and (C).

8. The composition of claim 7, wherein the modifier is oxidized starch, as the modified starch.

9. The composition of claim 2, wherein the additional copolymerized units in the copolymer are styrene units.

10. The composition of claim 9, wherein the modifier is oxidized starch, as the modified starch.

* * * * *